United States Patent [19]

Duncan

[11] Patent Number: 4,815,890

[45] Date of Patent: Mar. 28, 1989

[54] LOW LEVEL TRAFFIC DIRECTION PAVEMENT MARKER

[76] Inventor: Terence J. Duncan, 22634 13th Ave. South, Des Moines, Wash. 98198

[21] Appl. No.: 220,985

[22] Filed: Jul. 14, 1988

Related U.S. Application Data

[63] Continuation of Ser. No. 900,510, Aug. 26, 1986, abandoned.

[51] Int. Cl.[4] ..... E01F 9/06

[52] U.S. Cl. ..... 404/15; 404/16

[58] Field of Search ..... 404/1, 9, 11–16; 350/104, 97; 116/63 R; 40/612

[56] References Cited

U.S. PATENT DOCUMENTS

| | | | |
|---|---|---|---|
| 1,578,995 | 3/1926 | Hostetter | 404/16 |
| 2,094,652 | 10/1937 | Hershman | 404/16 |
| 2,599,230 | 6/1952 | Carroll | 404/15 |
| 2,703,773 | 3/1955 | Stimson | 350/97 X |
| 3,049,980 | 8/1962 | Gill, Jr. | 404/13 |
| 3,179,009 | 4/1965 | Sheffield et al. | 404/12 X |
| 3,418,896 | 12/1968 | Rideout | 404/14 X |
| 3,936,207 | 2/1976 | Sticha | 404/1 X |
| 4,145,112 | 3/1979 | Crone et al. | 404/14 X |
| 4,428,320 | 1/1984 | Oplt et al. | 404/14 X |
| 4,626,127 | 12/1986 | May | 404/14 |
| 4,653,955 | 3/1987 | Racs | 404/14 |

FOREIGN PATENT DOCUMENTS

| | | | |
|---|---|---|---|
| 873809 | 3/1953 | Fed. Rep. of Germany | 404/15 |
| 355894 | 9/1931 | United Kingdom | 404/12 |

*Primary Examiner*—Jerome W. Massie
*Assistant Examiner*—Matthew Smith
*Attorney, Agent, or Firm*—Roy E. Mattern, Jr.

[57] ABSTRACT

A low level traffic direction pavement marker is secured, at spaced distances with others, to early alert, inform, and guide a motorist, via contrast, emphasis, and directional position, in his or her correct vehicle maneuver in a special channelization. An elongated body less than an inch high, four inches wide, and available in lengths of 6, 8, 10, or 12 inches, of elliptical top shape, has: a planar bottom surface for receiving a bonding material; a curved top surface sloping downwardly in all directions, from a highest central portion; a surrounding continuous side surface, angled inwardly at 60 degrees, from the bottom surface, and extending to the curved top surface; a reflective material optionally positioned on this surrounding continuous side surface; a transition shoulder extending about the entire bottom surface from the planar bottom surface to the surrounding continuous side surface; and a transition shoulder extending about the entire curved top surface from the curved top surface to the surrounding continuous side surface, these shoulders being effective in protecting the reflective material; and a transversely arranged group of three straight lines having a common central crossing, presented on the highest central portion, with one line being perpendicular to a longitudinal axis, and the other two lines being at respective opposite angles from the perpendicular line, used in arranging these pavement markers to indicate either a division of driving lanes, or a change in direction to the right or left.

9 Claims, 2 Drawing Sheets

FIG.5
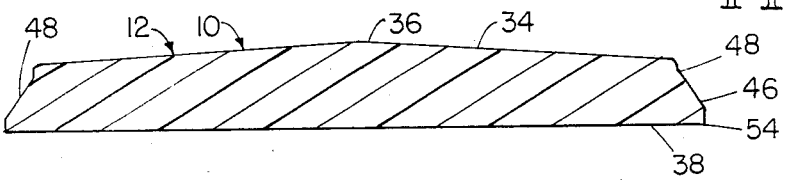
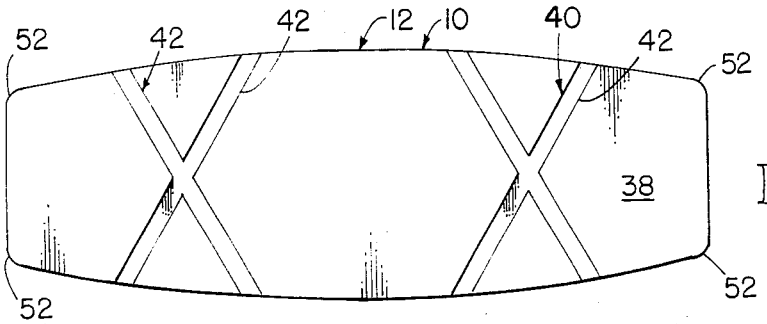
FIG.6
FIG.7
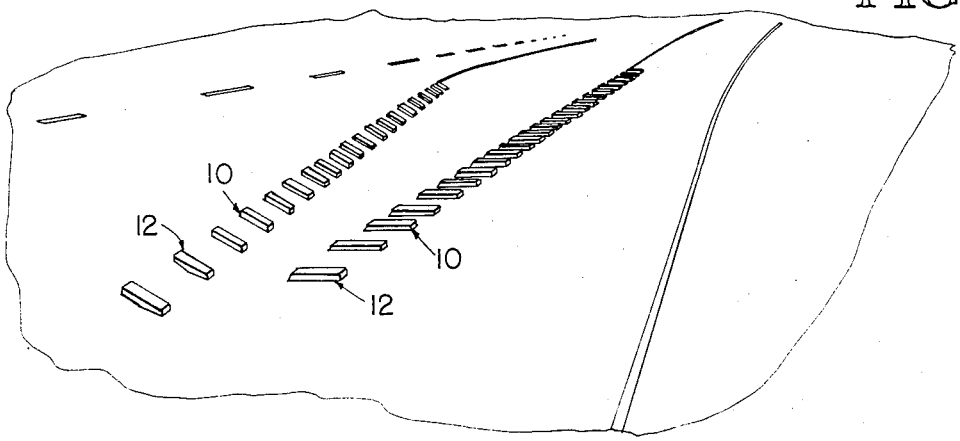
FIG.8
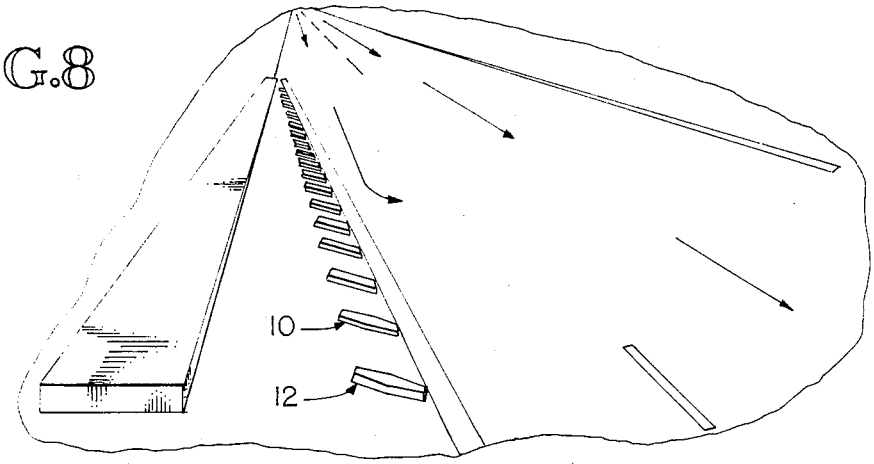

LOW LEVEL TRAFFIC DIRECTION PAVEMENT MARKER

This application is a continuation of application Ser. No. 900,510, filed 8/26/86, abandoned.

BACKGROUND OF THE INVENTION

Traffic direction pavement markers, paintings, curbing, raised islands, rumble bars and high buttons have been used and are being used to assist drivers of vehicles, soon enough in their decision times to make timely important and/or critical maneuvers in many locations and especially in potentially hazardous locations along highways, roadways, and city streets. Drivers today observe spaced lane markers to determine the left and right sides of a traffic lane. Painted stripes are also used to aid drivers in their determinations of the left and right sides of a traffic lane.

Although paint and/or small spaced lane markers have also been used to make drivers more acutely aware of the lane ahead being changed in size and/or in direction or having a departing lane, generally different pavement level and near pavement level markings, paintings, rumble bars, curbings, raised larger buttons, raised islands, and raised gore areas are utilized by those persons designing, making, and maintaining the highways, roadways and city streets. However, recent considerations and studies of accidents which occurred when a motorcycle, car, or truck ran over curbing, a raised island, a raised gore area, and/or higher and larger buttons, have indicated that these markers, while serving their initial purpose, have also caused some serious accidents, when a driver fails to direct his or her vehicle soon enough and strikes these higher markings, when trying to stay in a lane, or to make a change in direction of the lane, to leave a lane, to enter a lane, or to avoid a lane. As a consequence of these considerations, some of which resulted from successful legal suits undertaken by injured persons, who received sizeable sums, via settlements and/or judgments, some state regulations and specifications have been changed. No longer will raised islands, raised gore areas, curbing, and higher and larger buttons be used. Therefore, there is a need for traffic control devices to be located at pavement levels to aid a motorist, yet not cause the motorist trouble if he or she unwantedly drives a vehicle over the traffic control devices.

No longer do the highway designers, engineers, and other personnel concerned with pavement level or near pavement level markers, want to specify the hard round larger buttons, which have been referred to as launching pads. Nor do they want high curbings, high islands, or higher type rumble bars. The latter are elongated bars having a transverse cross section formed with a curved top determined by a comparatively large radius, and the ends slope downwardly. They are positioned ahead of bridge abutments, wall dividers, road edge rails and fences, and signs to warn a motorist of the impending danger of hitting these formidable structures, so the motorists will promptly and timely redirect his or her vehicle back into the traffic lane to thereby clear such a structure.

In reference to selected United States patents some of the prior traffic control devices located at or near pavement level are set forth in these patents:

U.S. Pat. No. 3,332,327 of 1967 wherein Sidney Heenan disclosed his pavement marker secured to a roadway surface to return the incident light coming from vehicle headlights as refracted light in a parallel direction. The obverse face of this pavement marker made an acute angle of at least fifteen degrees with the base and rose above the roadway surface to maintain an adequate optical effectiveness during service, while allowing wiping of this obverse face by tire contacts of passing vehicles. The internal reflective elements were of the cube corner type. The overall shape involved a larger rectangular base, a small rectangular top, with surrounding fifteen degree inwardly sloping sides;

U.S. Pat. No. 3,485,148 of 1969, wherein Sidney Heenan disclosed his pavement markers with selectively replaceable reflectors. These markers were rectangular at a large base and then sloped upwardly at fifteen degrees to a small rectangular top. The replaceable reflectors incorporated cube corner type internal reflectors;

U.S. Pat. No. 3,785,719 of 1974, wherein Nelson Jonnes disclosed his roadway lane delineator having an elastomeric reflective portion supported by a base portion, and having a retro-reflective material positioned on the reflective portion. The elastomeric portions deflected under tire pressure or snow plow pressures, so the reflection capabilities had a longer active life, before the retro-reflective materials were replaced, or the entire delineator was replaced;

U.S. Pat. No. 3,836,226 of 1974, wherein James A. Cechetini disclosed his reflective pavement marker having an inside trapezoidal support block of glass spheres in a cement binder surrounded by a reflective acute angled side grid having diamond shaped reflectors. Then they together were covered by a layer of light-refractive translucent material also serving in the light reflection of vehicle headlights and protecting the side grid and the support block;

U.S. Pat. No. 3,922,066 of 1975, wherein Howard A. Schaefer disclosed his reflective roadway marker made of glass formed to provide an optical system to reflect vehicle headlights, and to receive internally and lowly, a potting compound used in securing this marker to the roadway. In one embodiment, in the top view, the marker appears as an elongated ellipse, and in one long side view as a dome;

U.S. Pat. No. Re. 31,291 of 1983, wherein Ludwig Eigenmann disclosed his road surface marking prefabricated tape material having retroreflective composite elements associated therewith. The latter were positioned high enough to reflect vehicles' headlights and they contained cube corner reflectors; and U.S. Pat. No. 4,428,320 of 1984, wherein David W. Oplt disclosed his reflective paving marker used to delineate traffic lanes. A light weight molded plastic support structure had a bottom with slight recesses to create a grip in the adhesive attachment of the marker to the pavement. Also this light weight support had inclined slight recesses to receive thin strips of reflective polycarbonate tape which reflected vehicle headlights. The recesses were deep enough to protect this reflective tape from the abrasive effects of the tires of passing vehicles.

Although the currently used markers and stripes, and these patents indicate the progress made in providing pavement markers, there remained a need for pavement markers which could be used at locations where the motorist would be required to do more than proceed generally ahead on selected parallel traffic lanes, which were well marked, on a highway. Such locations are many, for example: when a motorist in operating his or her vehicle, is leaving or returning to a highway, making left turns by entering pockets, merging from two lanes into one, approaching a danger area such as a blind driveway, arriving at a wider street expanse having a common middle lane for left turns, approaching nearby lane structures, such as bridge abutments, traffic control walls or barriers, sign posts, light posts, and approaching ditches, excavations and holes.

SUMMARY

A low level traffic direction pavement marker is secured with others to pavement to early alert, inform, and guide a motorist, via contrast and emphasis, and directional position, in his or her correct vehicle maneuver in a special channelization occurring with respect to: exit and entrance ramps; lane reduction and multilane transitions, left turn pockets, medial islands, gore areas, turnouts, obstruction markings, sharp curves, hidden roads and driveways. Although this pavement marker presents a low level profile it remains very effective to guide a motorist. Yet if a driver of a car, truck, or motorcycle is not able to completely maneuver into a special channelization, this low level traffic direction pavement marker will not cause a loss of control of the vehicle. In contrast, built up islands, curbing, and large buttons have been known to cause a loss of control of a vehicle.

In the daylight, the overall distinctive shapes of these low level traffic direction pavement markers and their positioning in groups, at selected spaces and angles, often at preselected alike angles, quickly indicate to a motorist, via contrast and emphasis, the correct maneuver to make in ample time. Then, when this same indication must be made to motorists driving at night, the reflective surfaces of these low level traffic direction pavement markers are provided with reflective materials to amply reflect the light of the headlights to create an informative image to a driver, through an approaching angular range, so he or she will timely undertake th correct maneuver, via understanding the multiple images of these spaced low level traffic direction pavement markers.

In these preferred embodiments, they are less than an inch in height, four inches wide, and available in lengths of 6, 8, 10, or 12 inches. They are provided in an elliptical top view shape having a domed top surface and a planar bottom surface, with the surrounding side being at a sixty degree angle with respect to the bottom surface. The locales where the surrounding side commences and stops, have shoulders which receive the rolling forces of tires and which are therefore effective in protecting the surrounding side from excessive wear. Then, if reflective paint materials, or reflective tapes are placed on the surrounding side, they tend to remain actively effective for longer periods of time, in reflecting back the lights of oncoming vehicles These low level traffic direction pavement markers are often bonded to pavement along the paint stripe line and the striping paint is also applied to them at the same time the stripe is being painted. Moreoften the striping paint includes light reflecting materials and a motorist is well guided both in the daytime and night time by these markers positioned along a paint stripe.

In preparing a motorist for a turn, or in signalling a motorist not to turn, these low level traffic direction pavement markers are set at informative like angles, either fifteen degrees to the right or left. To aid a work person in setting them, a set of three straight lines is provided on the central portion of the domed surface of each marker. They have a common midpoint. One line is perpendicular to the longitudinal axis of the marker and the other two lines are respectively at a fifteen degree angle with respect to the perpendicular line.

As so formed, covered, spaced and secured to pavements, these low level traffic direction pavement markers, via their excellent contrast and emphasis, are readily observed by motorists, so they make timely and accurate maneuvers, while overall structure keeps them clean driving their vehicles. Their overall structure keeps them clean and useful for comparatively longer periods of time, and they are less susceptible to damage via the wheels of vehicles. During night travels, when these markers are equipped with light reflecting materials, the effective range of reflective light from a vehicle's headlights is extensive, both in respect to a straightaway distance, as well as an arcuate range of observation by a motorist in redirecting his or her vehicle.

DRAWINGS OF THE PREFERRED EMBODIMENT

The low level traffic direction pavement marker and some locales of its installation with other markers at respective spaces are illustrated in the drawings, wherein:

FIG. 1 is a perspective view from above of two one way straight ahead lanes of a highway, where there is also a right turn departing lane, illustrating the placement of two groups of spaced low level traffic direction pavement markers, both groups having the individual markers set at respective fifteen degree angles, and these groups arranged to define the start of a gore area, and to create by contrast, emphasis, and directional positions, the commencement of the left side of the right turn departing lane, and the continuation of the right side of the right straight ahead lane of the through traffic lanes as timely viewed by the oncoming motorist;

FIG. 5 is a longitudinal sectional view, taken along line 5—5 of FIG. 2, indicating how the central portion of this pavement marker has a curved or domed top surface, whereby water poured evenly on this central portion flows freely in all directions, for the dome extends throughout the top surface of this pavement marker;

FIG. 6 is a bottom view, indicating how the bottom surface of this pavement marker, optionally has intersecting grooves to receive bonding material during the bonding of this pavement marker to the pavement;

Figure 1:
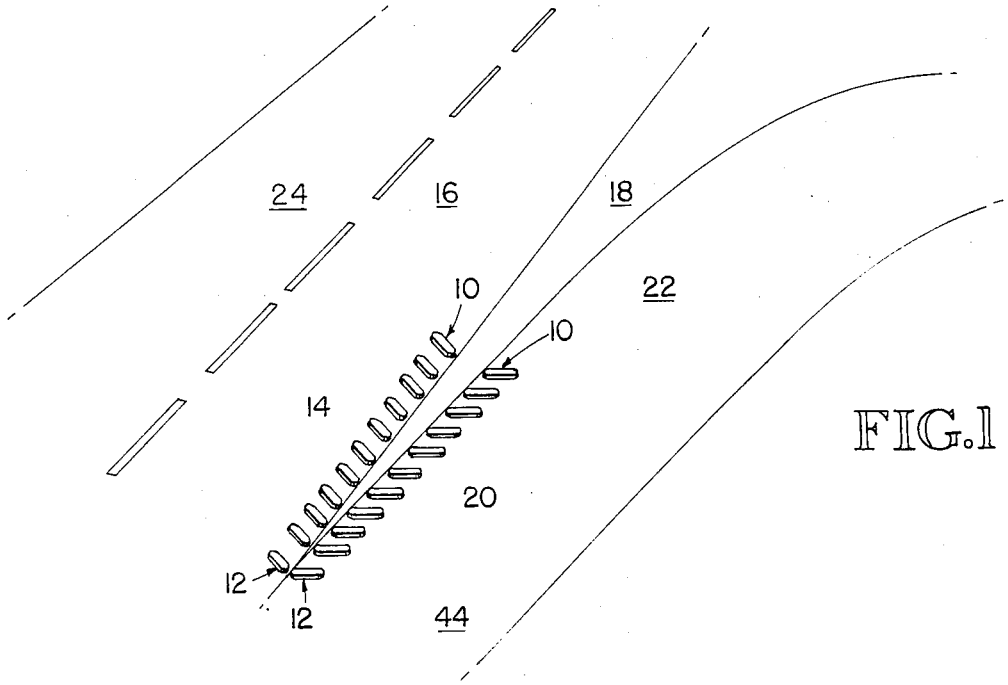

FIG. 7 is a perspective view of a highway locale somewhat similar to the locale shown in FIG. 1, but as viewed from the eye level of the motorist, who has followed the directions pictorially expressed via the contrast, emphasis, and directional positions of these low level traffic direction pavement markers, and he or she has successfully directed his or her vehicle into the right turn departing lane; and FIG. 8 is a perspective view of a street locale indicating how these low level traffic direction pavement markers are used to indicate to motorists that two lanes of traffic are converging into one lane of traffic, and indicating how, optionally, a painted stripe is used in conjunction with them.

DESCRIPTION OF PREFERRED EMBODIMENTS

Many Locations of Use

Figure 2:
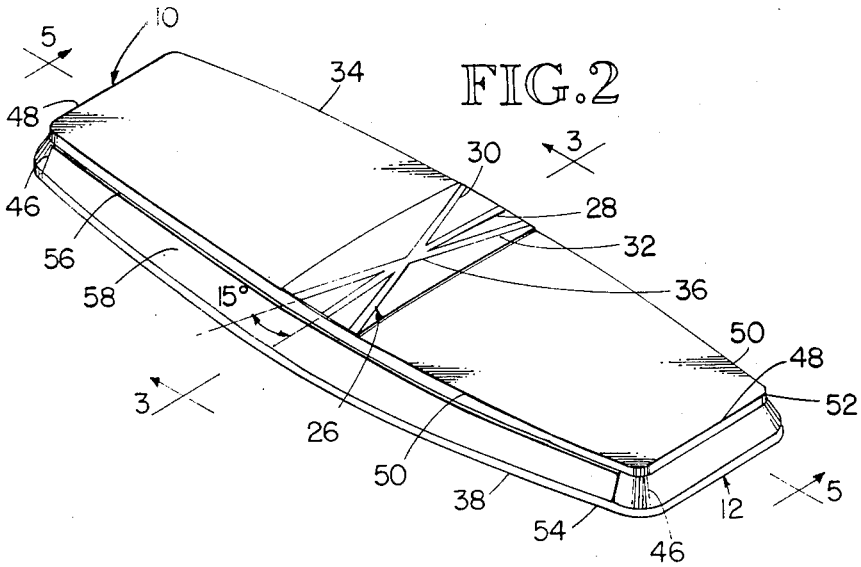
FIG. 2 is a perspective view of a larger low level traffic direction pavement marker which is installed as shown in FIG. 1, further indicating the set of three lines, used during its positioning on pavement.
Figure 3:
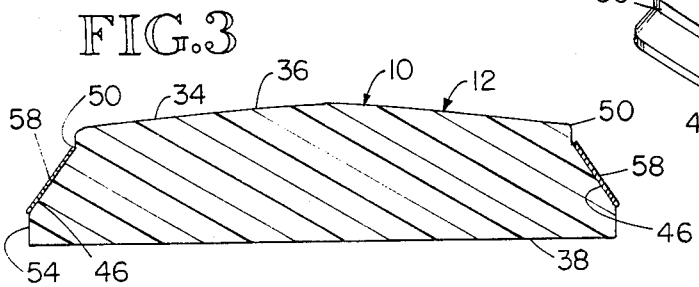
FIG. 3 is a transverse sectional view taken along line 3—3 of FIG. 2, indicating how the central portion of this pavement marker has a curved or domed top surface, and the sloping side surface is optionally covered by a reflecting material.

FIGS. 1, 7 and 8, by way of examples, illustrate how these low level traffic direction pavement markers 10 are secured at spaced locations with others in a group or groups to early alert inform and guide a motorist, via contrast, emphasis, and directional position, in his or her correct vehicle maneuver in a special channelization. In FIGS. 2, 3, and 5, the larger sized preferred embodiment 12 of these pavement markers 10 is illustrated. This larger sized embodiment 12 and others, are shown in FIG. 1 defining the start of a gore area, and creating by contrast, emphasis, and directional positions, both the commencement of the left side of the right turn departing lane, and the continuation of the right side of the right straight ahead lane of the through traffic lanes, so they will be timely viewed by the driver of the oncoming vehicle.

Arranged in Groups

As shown in FIG. 1, these pavement markers 10, are arranged in a group 14 of the right straight ahead lane 16 and bonded to the pavement at a fifteen degree offset angle relative to the right edge of this right straight away lane 16. In such positions, they together in this group signal to the observing driver, who is continuing on straight ahead, to stay left and to stay clear of the gore area 18. Then, as also shown in FIG. 1, these pavement markers 10, are arranged in another group 20 on the left side of the right turn departing lane 22, and bonded to the pavement at a fifteen degree offset angle relative to the left edge of this right turn departing lane 22. In such positions, they, together in this group, signal to the observing driver of the oncoming vehicle, who is turning right off the highway 24, to stay right and to stay clear of the gore area 18.

Their Positioning

These fifteen degree positioning groups are preferred, as shown in FIG. 1. However, their non angular positioning may be undertaken. The non angular positioning, or the fifteen degree, left or right, angular positioning of these low level traffic direction pavement markers 10 is undertaken conveniently, when they are optionally furnished, often via a disposable decal, with a set 26 of three straight lines having a common point. The center line 28 of this set 26 is perpendicular to the longitudinal axis of the pavement marker 10 and is utilized when this marker 10 is to be bonded with its longitudinal axis perpendicular to the edge of the traffic lane or another reference.

Preferred Specific Specifications of Preferred Embodiments

Figure 4:
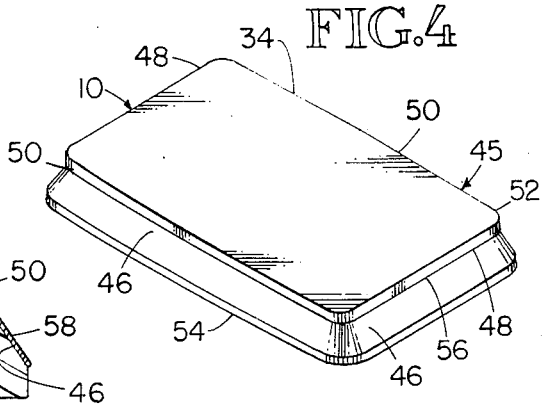
FIG. 4 is a perspective view of a smaller low level traffic direction pavement marker, which optionally does not have the set of three lines used during its positioning on pavement, nor does it have a reflective material, but it does have a central portion formed as shown in FIG. 3, with a curved or domed top surface.

These low level traffic direction pavement markers 10, as viewed from above, appear somewhat like an ellipse; however, in general it is trapezoidal in shape. There is an overall objective of providing excellent drainage so no dirt will collect. Therefore the entire top surface 34 curves downwardly from the center 36, in all directions, in what is referred to as a dome. The bottom 38 is planar and smooth, except when optionally provided with respective sets 40 of grooves 42 as shown in FIG. 6, which receive bonding materials. Certain types of these bonding materials require the utilization of these sets 40 of grooves 42 to increase the overall holding strength of the selected bonding material in keeping this pavement marker 10 in place on the pavement 44. Either one or two sets 40 of these grooves 42 are used depending on the length of this pavement marker. The smaller embodiment 45, shown in FIG. 4, would only have one set 40, if it were to be optionally provided. The preferred width of each groove 42 is one hundred twenty five thousandths of an inch. The depth slopes from near zero or zero at the centerline to one hundred thousandths of an inch at the forward and back edges. The included angle is thirty degrees between the crossing grooves 42.

Between this curved top surface 34 and the planar bottom 38, is the surrounding and continuous sloping surface 46. It is angled back or inwardly sloping back from bottom 38 to top 34 at a sixty degree angle in reference to the planar bottom 38. This preferred sloping angle has been selected to insure the reflection of the headlights of an oncoming vehicle will be observed soon enough, to alert the driver soon enough, so he or she will timely undertake the correct maneuver of a vehicle.

This pavement marker 10 is preferably made available in 8, 10, and 12 inch long sizes, but a 6 inch size is also available. Preferably in respect to all length sizes, the width of all sizes is 4 inches, to obtain the elliptical appearance as viewed from above. All of the ends 48 are shaped by using a 36 inch radius. With respect to the forward and back top edges 50, they are also shaped by using the same 36 inch radius.

The specific four corners 52 of the base of each pavement marker 10 are formed on a three quarters of an inch radius and are chamfered upwardly to eliminate any sharp edges. Also each pavement marker 10 has an almost perpendicular upstanding bottom shoulder 54 commencing at the planar bottom 38 and extending one hundred and twenty five thousandths of an inch, around the entire perimeter. Some inward sloping of this shoulder 54 is necessitated by the manufacturing processes and also to keep this shoulder 54 clean. Above this shoulder 54, the sloping surface 46 commences and extends essentially to the top surface 34. Preferably, however, all pavement markers 10 have a top shoulder 56 formed by using a one hundred and twenty five thousandths of an inch radius. This top shoulder 56 as shown in FIGS. 3 and 5, is substantially vertical, planar, and extends around the entire perimeter and serves as transition between the curved top 34 and the sloping surface 46, which also extends around the entire perimeter of each pavement marker 10. Moreover this top shoulder 56 serves to receive the major forces, if a wheel of a vehicle passes over the pavement marker 10. In so doing, this top shoulder 56 protects the sloping surface 46. This is particularly important when this sloping surface 46 is covered with a light reflecting material, which is either painted on, sprayed on, or placed thereon, via an adhesive backed strip of reflective material 58, as illustrated in FIGS. 2 and 3.

Low Height, Curved and Rounded Surfaces

Although these low level traffic direction pavement markers 10 serve extremely well to very early alert a driver, there will be times of bad weather, such as during freezing rain conditions, when vehicles may unwantedly be moving, in part, or completely across these pavement markers 10. Therefore they are configured, via low level profiles, and curved and rounded surfaces, so they will not be the source of reactive forces which could lead to the loss of control of a vehicle. The preferred curved and rounded surfaces have been described. In reference to the heights above the pavement, the nominal height of all pavement markers is preferred to be eight hundred seventy five thousandths of an inch. The top shoulder 56 commences at a height of seven hundred and fifty thousandths of an inch. Yet even at this preferred low height, preferably to be one inch or lower, these low level traffic direction markers 10, via their overall shape and their utilization in groups, such as groups 14 and 20, present equal or better information to the driver of an oncoming vehicle, than raised islands, curbings, and large buttons. Importantly this better information is made available, via these pavement markers 10, while eliminating the known dangers attributable to raised islands, curbings, and large buttons, when a vehicle strays from the proper traffic lane or traffic channel and hits these structures which create greater reactive forces.

White and Colors

These low level traffic direction pavement markers 10 are available with the outside being white and yellow to conform to highway standards. They are also available in other colors, such as red and blue. The colors are bright and retain their integrity.

Materials

When reflectivity is specified, die cut, self adhesive material strips 58 approximately one half of an inch in width are affixed to the sloping surface 46. This strip material is referred to as retroreflective material. Also glass beads, other reflective materials, and other reflective paints are used on these sloping surfaces 46. These materials are either applied at the time of manufacture or at the time of installation. Strip or stripe pavement painting may be undertaken over these pavement markers 10, after their bonding to the surface of pavement 44, and this painting may include reflective materials in the composition of the paint.

The material used uniformly throughout each pavement marker 10, is selected from several, such as a polyester resin, a thermoplastic, or a ceramic. These materials are of uniform composition and when finally formed are free from surface irregularities, which would otherwise interfere with the appearance, application, and/or durability of these low level traffic direction pavement markers 10. In reference to impact resistance, there should be no damage sustained by any of these pavement markers 10 when a one pound steel ball is dropped from a height of fifteen inches. The supporting strength should be eighteen hundred pounds minimum. The brightness in reference to the white color is eighty percent minimum, and in reference to color purity, such as a yellow color, the purity is seventy six to ninety six percent. When a solid polyester resin casting results in this low level traffic direction pavement marker 10, the 12 inch long larger marker embodiment 12 weighs seven hundred and ninety grams, and the weights are less for the other embodiments, and for example 6 inch long smaller marker embodiment 45 weighs four hundred and ten grams.

Securement Materials

The securement materials used will be those now specified by the respective governments. There are epoxies and/or bitumen tars.

Summary of Operational Advantages

Observations of these low level traffic directional pavement markers 10, in their respective groupings, present the driver with timely information to help him or her in maneuvering a vehicle from point A to point B, as expeditiously and safely as possible. It is a low level high visibility product, which is not a hazard to vehicles which unwantedly may pass over it. Moreover, this marker 10 serves equally well as a guidance means: during both daytime and nighttime; in normal or adverse weather conditions; and/or during normal or hazardous conditions. These low level traffic direction pavement markers 10, when arranged in their groups, create the special contrast and emphasis being observed by the driver, to visually relate to the driver, on a very timely schedule, what specific maneuver of his or her vehicle must soon be undertaken by his or her movements of the necessary operational controls of his or her vehicle.

I claim:

1. A low level traffic direction pavement marker to visually early alert, inform, and guide a motorist, via contrast, emphasis, and directional position, in his or her correct vehicle maneuver into special traffic lanes at many otherwise troublesome traffic areas, comprising an elongated body, less than or equal to one inch in height, of substantially elliptical shape, when viewed from above, having:

(a) a planar bottom substantially elliptical surface for receiving a bonding material for securement to the pavement;

(b) a curved top surface sloping downwardly in all directions from a highest central portion; and (c) a surrounding continuous side surface following a substantially elliptical path, angled inwardly at substantially sixty degrees in reference to the planar bottom, from the bottom surface and extending to the curved top surface;

(d) a planar first shoulder extending about the entire surrounding continuous side surface, defining the transition from the planar bottom surface to the surrounding continuous side surface; and (e) a substantially vertical planar second shoulder extending about the entire surrounding continuous side surface, and protecting the continuous side surfaces from vehicle wheel forces defining the transition from the curved top surface to the surrounding continuous side surface.

2. A low level traffic direction pavement marker, as claimed in claim 1, having a reflective surfaced layer on the surrounding continuous side surface.

3. A low level traffic direction pavement marker, as claimed in claim 1 or 2, having a transversely arranged group of three straight lines having a common central crossing, and presented across the surface of the highest central portion, with one line being perpendicular to a longitudinal axis of this marker, and the other two lines being at respective opposite angles from the perpendicular line, these lines being referred to in arranging these pavement markers at spaced locations on the pavement to indicate either a division of driving lanes, or a change in direction to the right or left, or into other special traffic lanes, at many otherwise troublesome traffic areas.

4. A low level traffic direction pavement marker to visually early alert, inform, and guide a motorist, via contrast, emphasis, and directional position, in his or her correct vehicle maneuver into special traffic lanes at many otherwise troublesome traffic areas, comprising, an elongated body, less than or equal to one inch in height, of substantially elliptical shape, when viewed from above, having:

(a) a planar bottom substantially elliptical surface for receiving bonding material for securement to a pavement;

(b) a curved top surface sloping downwardly in all directions from a highest central portion thereof, having in turn a transversely arranged group of three straight lines having a common central crossing, and presented across the surface of the highest central portion, with one line being perpendicular to a longitudinal axis of this marker, and the other two lines being at respective opposite angles from the perpendicular line, these lines being referred to in arranging these pavement markers at spaced locations on the pavement to indicate either a division of driving lanes, or a change in direction to the right or left, or into other special traffic lanes, at many otherwise troublesome traffic areas;

(c) a surrounding continuous side surface following a substantially elliptical path, angled inwardly at substantially sixty degrees in reference to the planar bottom, from the bottom surface and extending to the curved top surface;

(d) a planar first shoulder extending about the entire surrounding continuous side surface, defining the transition from the planar bottom surface to the surrounding continuous side surface; and (e) a substantially vertical planar second shoulder extending about the entire surrounding continuous side surface, defining the transition from the curved top surface to the surrounding continuous side surface.

5. A low level traffic direction pavement marker, as claimed in claims 1 or 4, wherein the substantially elliptical shape of the elongated body is based on using a radius of thirty six inches.

6. A low level traffic direction pavement marker, as claimed in claims 1 or 4, wherein the length of the elongated body is available at 4, 6, 8, 10, or 12 inches in length.

7. A low level traffic direction pavement marker, as claimed in claims 1 or 4, wherein:

the first shoulder, located at the bottom, is a near vertical 0.125 inch planar shoulder: and the second shoulder, located at the top, is a 0.125 inch radius shoulder.

8. A low level traffic direction pavement marker, as claimed in claim 2, wherein the surrounding continuous side surface's reflective surface layer comprises reflective paint and spaced glass beads.

9. A low level traffic direction pavement marker, as claimed in claim 2, wherein the surrounding continuous side surface's reflective surface layer comprises a retroreflective tape.

* * * * *